US007258624B2

(12) United States Patent
Kobayashi

(10) Patent No.: US 7,258,624 B2
(45) Date of Patent: Aug. 21, 2007

(54) GOLF CLUB AND METHOD FOR MANUFACTURING THE SAME

(75) Inventor: Kenji Kobayashi, Niigata-ken (JP)

(73) Assignee: K.K. Endo Seisakusho (JP)

( * ) Notice: Subject to any disclaimer, the term of this patent is extended or adjusted under 35 U.S.C. 154(b) by 245 days.

(21) Appl. No.: 10/894,231

(22) Filed: Jul. 19, 2004

(65) Prior Publication Data

US 2005/0037861 A1 Feb. 17, 2005

(30) Foreign Application Priority Data

Aug. 12, 2003 (JP) ..... 2003-292374

(51) Int. Cl.
*A63B 53/04* (2006.01)

(52) U.S. Cl. ..... 473/324; 473/345; 473/347; 473/348; 473/349; 473/409

(58) Field of Classification Search ..... 473/324, 473/345, 346, 347, 348, 349, 409; 156/245
See application file for complete search history.

(56) References Cited

U.S. PATENT DOCUMENTS

| | | | | |
|---|---|---|---|---|
| 5,497,993 | A * | 3/1996 | Shan | 473/329 |
| 6,723,007 | B1 * | 4/2004 | Chao | 473/342 |
| 6,969,326 | B2 * | 11/2005 | De Shiell et al. | 473/345 |
| 7,037,214 | B2 * | 5/2006 | Nakahara et al. | 473/345 |
| 7,094,159 | B2 * | 8/2006 | Takeda | 473/345 |
| 2005/0026723 | A1 * | 2/2005 | Kumamoto | 473/345 |
| 2005/0215351 | A1 * | 9/2005 | Hasegawa | 473/345 |
| 2005/0261082 | A1 * | 11/2005 | Yamamoto | 473/345 |
| 2005/0272527 | A1 * | 12/2005 | Sugimoto | 473/345 |
| 2006/0019769 | A1 * | 1/2006 | Lo | 473/345 |
| 2006/0052181 | A1 * | 3/2006 | Serrano et al. | 473/345 |
| 2006/0084525 | A1 * | 4/2006 | Imamoto et al. | 473/345 |

FOREIGN PATENT DOCUMENTS

| | | | |
|---|---|---|---|
| JP | 61-255677 | | 11/1986 |
| JP | 05-317465 | * | 3/1993 |
| JP | 06-304270 | | 11/1994 |
| JP | 2003-199848 | | 7/2003 |
| JP | 2003-205055 A | | 7/2003 |

* cited by examiner

*Primary Examiner*—Sebastiano Passaniti
(74) *Attorney, Agent, or Firm*—Akerman Senterfitt

(57) ABSTRACT

The partial crown portion member comprises: the edge frame made from metal; and the shell body provided inside the edge frame and made from resin enveloping the inner edge of the edge frame. Inside the edge frame, the plural through-holes penetrating the front surface of the edge frame to the rear surface thereof are provided, while the shell body is inserted in the through-holes by casting manner. Since the front and rear surfaces of the inner edge of the edge frame, the through-holes are enveloped by casting manner, the adhesiveness thereof can be enhanced.

9 Claims, 4 Drawing Sheets

GOLF CLUB AND METHOD FOR MANUFACTURING THE SAME

BACKGROUND OF THE INVENTION

1. Field of the Invention

The present invention relates to a golf club and a method for manufacturing the same.

2. Description of the Related Art

As conventional known techniques of joining a metallic outer shell and a fiber-reinforced-plastic-made outer shell in order to configure a head body employing a hollow structure, Japanese Unexamined Patent Publication No. 2003-205055 discloses ones such that: bonding a joining portion of the fiber-reinforced-plastic-made outer shell to both surfaces of a joining portion of the metallic outer shell; or forming a through-hole on the joining portion of the metallic outer shell so as to obtain joining strength of the metallic outer shell relative to the fiber-reinforced-plastic-made outer shell.

In those techniques, however, there is a problem that great adhesion can not be obtained when bonding them, and thus sufficient joining strength can not be obtained.

SUMMARY OF THE INVENTION

The present invention has been made to solve the above problems. It is, accordingly, an object of the present invention to enhance the coherence of metal and resin so as to sufficiently enlarge joining strength thereof in a golf club in which a shaft is connected to a golf club head employing a hollow structure such that the resin is embedded in the metal of an outer shell.

In order to attain the above object, according to a first aspect of the present invention, there is provided a golf club comprising: a golf club head formed by an outer shell member so as to be hollow; and a shaft connected to the golf club head, wherein the outer shell member comprises: an edge frame made from metal; and a shell body made from resin and provided inwardly relative to the edge frame, the shell body enveloping both front and rear surfaces of an inner edge of the edge frame.

By employing this structure, the shell body made from resin envelops the edge frame made from metal. Accordingly, joining thereof can be enhanced, and thus strength of the golf club head can be enhanced.

In the above-explained golf club, a plurality of through-holes penetrating from a front surface of the edge member to a rear surface thereof may be provided on an inward portion of the edge member; and the resin of the shell body may be inserted into the plurality of through-holes.

Alternatively, the resin of the shell body may have translucency.

In order to attain the above object, according to a second aspect of the present invention, there is provided a method for manufacturing a golf club, the golf club comprising: a golf club head formed by a plurality of partial outer shell members so as to be hollow; and a shaft connected to the golf club head, each partial outer shell member comprising: an edge frame made from metal; and a shell body made from resin and provided inwardly relative to the edge frame, the shell body enveloping both front and rear surfaces of an inner edge of the edge frame, wherein the method includes steps of: inserting the edge frame into a pair of molds; closing the pair of molds and filing molten resin of the shell body into the pair of closed molds; and allowing the molten resin of the shell body to envelop an inner edge of the edge frame by casting manner so that the edge frame and the shell body are integrated with each other.

According to the above-explained method, the molten resin of the shell body envelops the inner edge of the edge frame made by casting manner so that the shell body and the edge frame are integrated with each other. Therefore, adhesiveness of the edge frame and the shell body can be enhanced, and thus strength of the golf club can be enhanced.

Moreover, the above-explained method may further include steps of: forming a first air gap between a front surface of the inner edge of the inserted edge frame and one of the mold facing the front surface of the inner edge of the inserted edge frame, when the pair of molds are closed; forming a second air gap between a rear surface of the inner edge of the inserted edge frame and an other of the mold facing the rear surface of the inner edge of the inserted edge frame, when the pair of molds are closed; and filling the molten resin into the first and second air gaps.

Alternatively, in the above-explained golf club, the edge frame made from metal may have a plurality of reinforced ribs provided in a reticular pattern; and the shell body made from resin may envelop the plurality of reinforced ribs by casting manner.

Further, in the above-explained golf club, the plurality of reinforced ribs may comprise: a plurality of first reinforced ribs each perpendicular to a face of the golf club head; and a plurality of second reinforced ribs each parallel to the face of the golf club head.

Still further, in the above-explained golf club, the edge frame made from metal may have a plurality of first reinforced ribs each perpendicular to a face of the golf club head; and the shell body made from resin may envelop the plurality of first reinforced ribs by casting manner.

Moreover, in the above-explained golf club, the edge frame made from metal may have a plurality of second reinforced ribs each parallel to a face of the golf club head; and the shell body made from resin may envelop the plurality of first reinforced ribs by casting manner.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Figure 1:
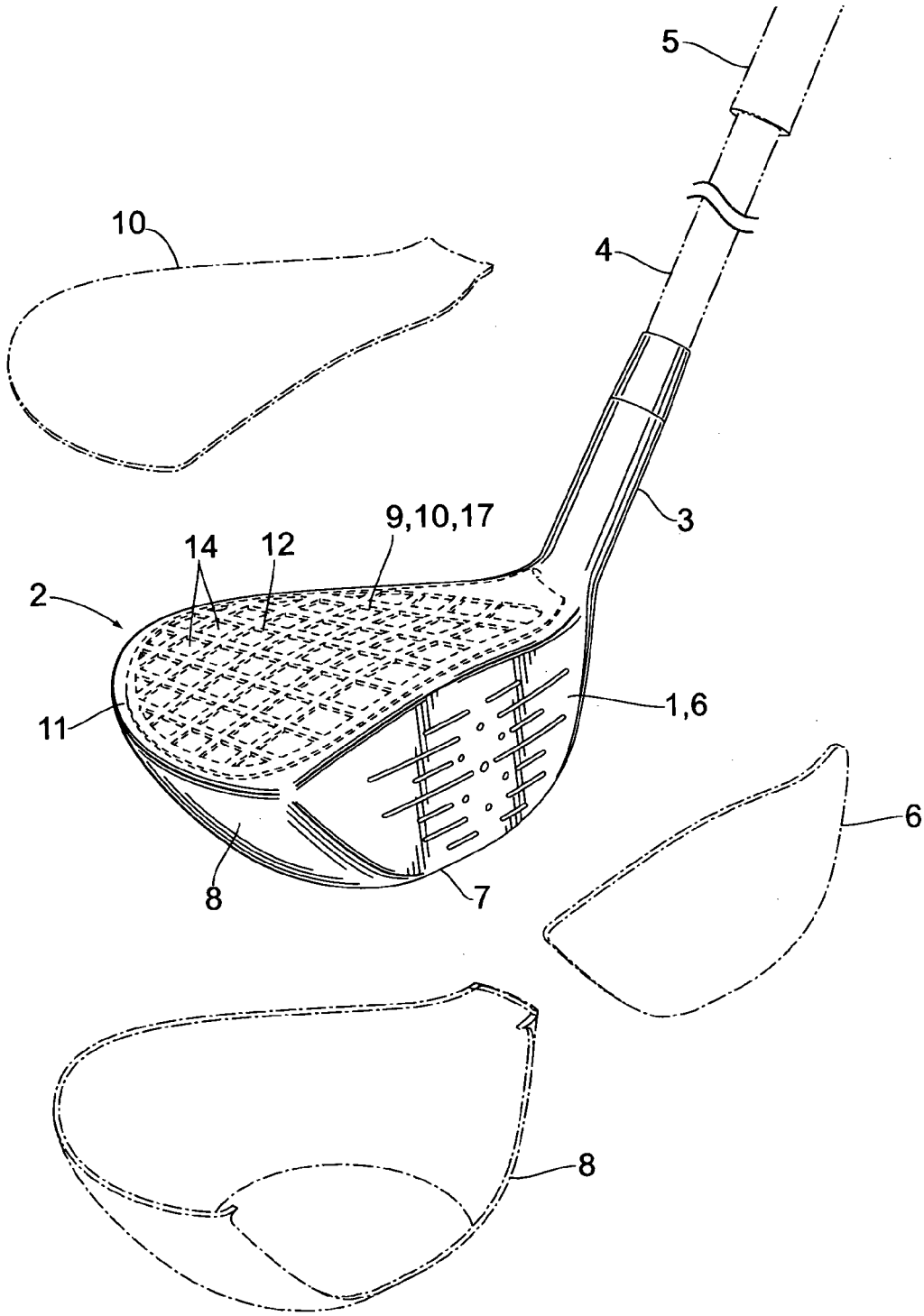
FIG. 1 is a perspective view showing a golf club according to a first embodiment of the present invention.
Figure 2:
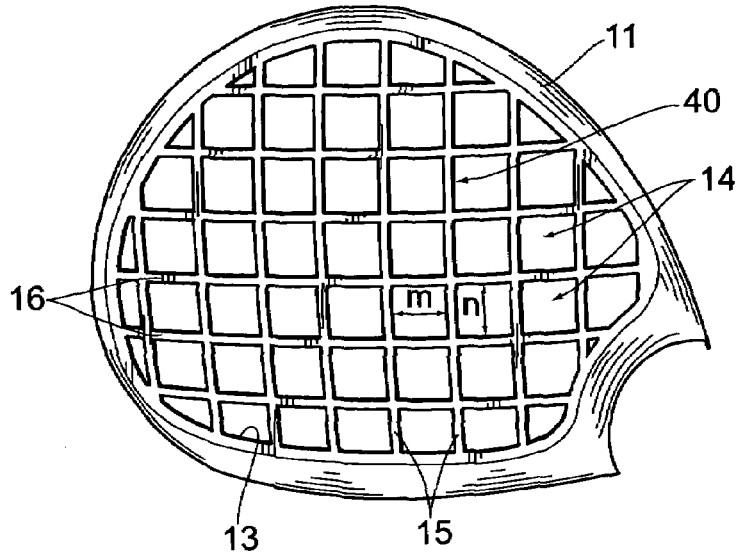
FIG. 2 is a top plan view showing an edge frame having reinforced ribs according to the first embodiment of the present invention.
Figure 3:
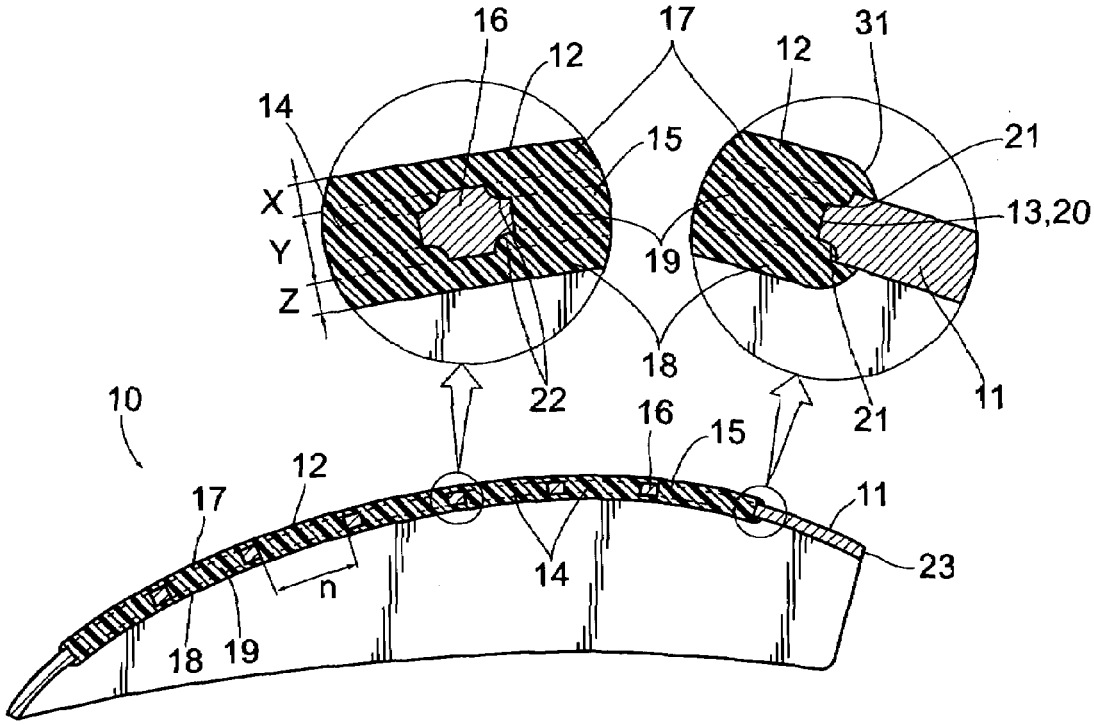
FIG. 3 is an enlarged longitudinal cross sectional view showing a part of a head of a golf club according to the first embodiment of the present invention.
Figure 4:
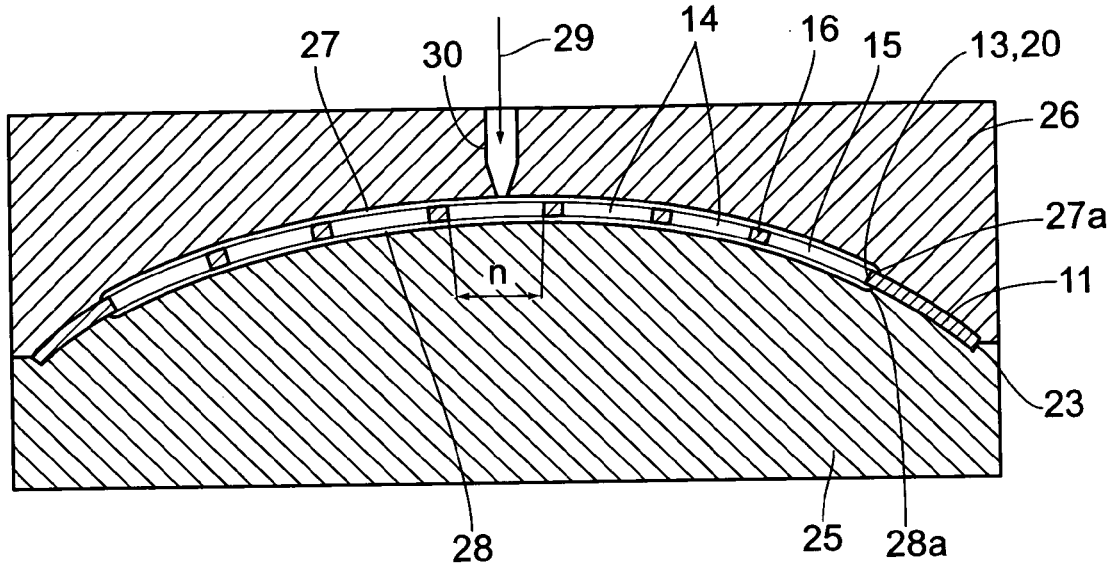
FIG. 4 is a cross sectional view for explaining a manufacturing method of the golf club according to the first embodiment.

Preferred embodiments of the present invention will now be described in detail with reference to the accompanying drawings.

First Embodiment

FIGS. 1 to 4 show a wood type golf club head according to a first embodiment of the present invention. This wood type golf club comprises: a golf club head 2 (hereinafter, head 2) having a face 1 on its front; a shaft 4 (shown by chain double dashed lines) having a bottom end connected to a neck 3 formed on one side of the head 2; and a grip 5 provided on the upper portion of the shaft 4. As shown by chain lines, the head 2 employs a hollow structure formed by joining a plurality of partial outer members so as to include: a partial face portion member 6 forming the face 1; a partial sole-peripheral side surface portion member 8 forming a sole 7, right, left and rear portions of the head 2; a partial crown portion member 10 forming a crown 9; and a neck member (not shown) formed in a cylindrical shape protruding from the one side of the head 2 so as to form the neck 3. Each edge, etc. of the partial shell members are joined by welding such as laser welding so as to be integrated one another.

Both of the partial face portion member 6 and the partial sole-peripheral side surface portion member 8 comprise machined metal plates made from pure titanium, titanium alloy, aluminum alloy, stainless steel or the like. The partial crown portion member 10 comprises: an edge frame 11 as a metal frame; and a shell body 12 made from resin (plastic) and provided inwardly relative to the edge frame 11. The edge frame 11 forms an edge of the crown 9. On a window opening 13 surrounded by the edge frame 11, reinforcing ribs 40 is provided in a reticular pattern so as to form a plurality of through-holes 14, while each reinforcing rib 40 is formed in a bar shape. The edge frame 11 having the reinforcing ribs 40 comprises a machined metal plate made from titanium alloy, aluminum alloy, stainless steel or the like. The reinforced ribs 40 comprises: a plurality of first reinforced ribs 15 each parallel to a front-rear direction (a direction perpendicular to a surface of the face 1) with essentially constant intervals m, while both ends thereof are connected with the edge frame 11; and a plurality of second reinforced ribs 16 each parallel to a right-left direction (a direction parallel to the surface of the face 1) with essentially constant intervals n, while both ends thereof are connected with the edge frame 11. The shell body 12 made from resin entirely covers the window opening 13 in the edge frame 11. It has a front surface portion 17, a rear surface portion 18, and an insertion portion 19 connecting the front and rear surface portions 17, 18 by penetrating through the through-holes 14. Example of the resin of the shell body 12 is fiber-reinforced-plastic formed by infiltrating reinforced fiber with matrix resin. As examples of the reinforced fiber, carbon fiber, glass fiber and aramid fiber can be considered, while epoxy resin such as polybutylene terephthalate, unsaturated polyester resin and vinyl ester resin can be considered as examples of the matrix resin. As a character of the matrix resin, it is preferable that specific density thereof is smaller than those of the edge frame 11 and reinforced ribs 40, Specifically, less than or equal to value of 2 specific gravity, and further less than or equal to value of 1.7 specific gravity are suitable. Moreover, less than or equal to 0.1% of water absorption coefficient is preferable (at 23° C., in water for 14 hours), while equal to or more than value of 50 Rockwell hardness (at 23° C., in "M" scale) is also preferable. Meanwhile, the resin of the shell body 12 may be single polyamide resin or fiber-reinforced resin thereof. In a case where the resin of the shell body 12 is clear or half-transparent, and has translucency, inside the head 2 can be visible.

Further, front and rear surfaces of the shell body 12 adjacent to the inner edge 20 of the edge frame 11 form a concaved portion 21 so that the respective concaved portion 21 becomes gradually thin toward a center of the thickness direction of the edge frame 11. Correspondingly, front and rear surfaces of an edge of the respective reinforced ribs 40 form a concaved portion 22 so that the respective concaved portion 22 becomes gradually thin toward a center of the thickness direction thereof. The resin-made shell body 12 envelops the reinforced ribs 40 by casting manner, while the shell body 12 entirely covers the inner edge 20 of the edge frame 11 with essentially the same thickness. It covers the concaved portion 21 adjacent to the inner edge 20 of the edge frame 11, except an outer edge 23 thereof, and sandwiches the concaved portion 22 by the front surface portion 17 and the rear surface portion 18. Meanwhile, in FIG. 3, thickness of the front surface portion 17 is represented by "X", thickness of the edge frame 11 and those of the reinforced ribs 40 essentially the same as that of the edge frame 11 (that is, thickness of a insertion portion 19) is represented by "Y", and thickness of the rear surface portion 18 is represented by "Z". The thicknesses of all X, Y and Z are, for example, essentially same.

Next, a method for manufacturing the above-described golf club according to this embodiment will now be described. First, a piece of metal plate is bent and punched out by press working in order to form the edge frame 11 and the reinforced ribs 40 of the window opening 13 integrated one another. Next, the edge frame 11 with the reinforced ribs 40 is placed on a first mold 25, and then the first mold 25 is closed by a second mold 26. In a condition where the edge frame 11 is inserted and the molds 25, 26 are closed, a first air gap 27 communicating the through-holes 14 is formed on between: both of the front surfaces of the edge frame 11 and the reinforced ribs 40; and the second mold 26 facing those front surfaces, while a second air gap 28 for molding is formed on between: both of the rear surfaces of the edge frame 11 and the reinforced ribs 40; and the first mold 25 facing those rear surfaces. Outer edges 27*a*, 28*a* of the first and second air gaps 27, 28 are provided slightly outwardly relative to inner edges thereof.

Then, as illustrated by an arrow 29, molten resin is filled into the first and second air gaps 27, 28 with a predetermined pressure. In this embodiment, the molten resin is subjected to injection molding via a resin path 30. Accordingly, the resin sandwiches the concaved portions 21 from its front and rear with a molding pressure so that the inner edges 20 are enveloped by casting manner, and thus an outer edges 31 of the resin-made shell body 12 are formed. Moreover, under the injection pressure due to the injection of the molten resin, the reinforced ribs 40 are enveloped between the front surface portion 17 and the rear surface portion 18 by casting manner so as to form a central portion of the shell body 12, while the through-holes 14 between the reinforced ribs 40 are filled with the molten resin, and thus the insertion portion 19 connecting the front surface portion 17 and the rear surface portion 18 are integral molded.

As described above, according to the first embodiment of the present invention, the partial crown portion member 10 forms the head 2 with the partial face portion member 6 and the partial sole-peripheral side surface portion member 8.

The partial crown portion member 10 comprises: the edge frame 11 made from metal; and the shell body 12 provided inwardly relative to the edge frame 11, the shell body 12 made from resin enveloping the inner edge 20 of the edge frame 11. Accordingly, it can be light weighted compared to one made from metal only. Further, adhesion of the edge frame 11 and the shell body 12 can be enhanced since both of the front and rear surfaces of the inner edge 20 are enveloped by casting manner.

Moreover, joining of the edge frame 11 and the shell body 12 can be enhanced in the inward of the edge frame 11 since the plurality of through-holes 14 penetrating the front surface of the edge frame 11 to the rear surface thereof are formed on inward side of the edge frame 11; and the shell body 12 is inserted in the plurality of through-holes 14 by casting manner.

Further, since the shell body 12 forming a part of the partial crown portion member 10 is made from clear or half-transparent translucency resin, positional relationship of a ball and the sole 7/face 1 when hitting the golf ball can be visible by watching a front surface of the partial sole-peripheral side surface portion member 8 and a rear surface of the partial face portion member 6 through the translucency shell body 12.

Still further, by carrying out the molding while applying the pressure to the molten resin when: inserting the edge frame 11 in the molds 25, 26; closing the molds 25, 26; filling the molten resin by injection molding or the like; and enveloping the inner edge 20 of the edge frame 11 by the molten resin of the shell body 12 so that the edge frame 11 and the shell body 12 are integrated with each other, the edge frame 11 and the reinforced ribs 40 can be adhere to the resin while utilizing that pressure applied to the molten resin. Accordingly, joining strength of the resin-made shell body 12 and the metallic edge frame 11/reinforced ribs 40.

Furthermore, by forming the first and second air gaps 27, 28 and filling the molten resin thereinto when the edge frame 11 having the plurality of reinforcing ribs 40 is inserted into the molds 25, 26 and the molds 25, 26 are closed, adhesiveness of the inner edge 20 of the edge frame 11 and the outer edge 31 of the resin-made shell body 12 can be further enhanced.

Second Embodiment

Figure 5:
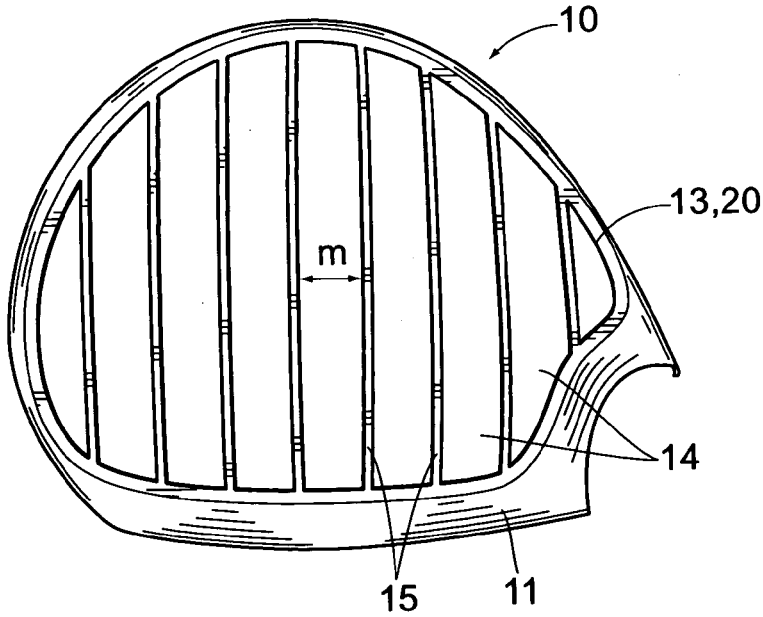
FIG. 5 is a top plan view showing an edge frame having reinforced ribs according to a second embodiment of the present invention.

FIG. 5 shows a partial crown portion member 10 of a golf club according to a second embodiment of the present invention. The same reference numbers will denote the same structure portions as those of the golf club according to the first embodiment, while detailed explanations thereof will be omitted. In the second embodiment, the plurality of first reinforced ribs 15 are provided, in parallel to the front-rear direction, on the window opening 13 which is inwardly provided relative to the edge frame 11. By these first reinforced ribs 15, durability of the edge frame 11 along the front-rear direction can be enhanced.

Third Embodiment

Figure 6:
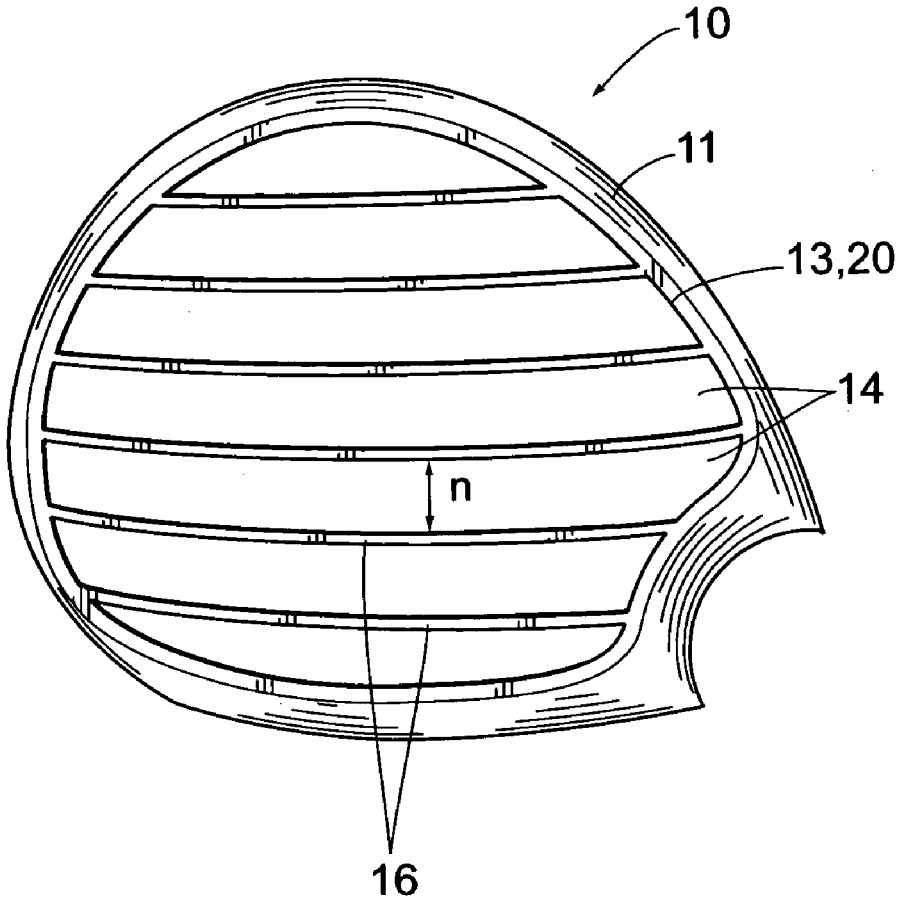
FIG. 6 is a top plan view showing an edge frame having reinforced ribs according to a third embodiment of the present invention.

FIG. 6 shows a partial crown portion member 10 of a golf club according to a third embodiment. The same reference numbers will denote the same structure portions as those of the golf club according to the first embodiment, while detailed explanations thereof will be omitted. In the third embodiment, the plurality of second reinforced ribs 16 are provided in parallel to the right-left direction, on the window opening 13 which is provided inwardly relative to the edge frame 11. By these second reinforced ribs 16, durability of the edge frame 11 along the right-left direction can be enhanced.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention within the claims are to be regarded to be in the scope of the present invention.

For example, the present invention can be applied to not only a wood type golf club, but also ones of the other types, such as an iron type golf club. Moreover, whilst the case that the present invention is applied to the partial crown portion member, but it may be applied to the partial face portion member or the partial sole-peripheral side surface portion member. Further, the hollow-structure head may employ a structure such that a filler such as a foamed material is filled therein.

What is claimed is:

1. A golf club comprising: a golf club head having a face on a front and formed by an outer shell member so as to be hollow; a shaft having a bottom end connected to a neck formed on one side of said golf club head; and a grip provided on an upper portion of said shaft, wherein said outer shell member comprises:

an edge frame made from metal; and a shell body made from resin and provided inwardly relative to said edge frame, said shell body enveloping and entirely covering both front and rear surfaces of an inner edge of said edge frame with the same thickness by a casting manner, wherein said edge frame comprising a metal has an inner edge, wherein a front surface a rear surface of the edge frame adjacent to said inner edge form a concave portion such that the inner said becomes thinner;

said edge frame made from metal has a plurality of reinforced ribs provided in a reticular pattern, wherein said plurality of reinforced ribs have a front surface and a rear surface that form a concave portion near an edge of said reinforced ribs such that the edge of said reinforced ribs becomes thinner; and said shell body made from resin envelops said plurality of reinforced ribs by a casting manner.

2. The golf club according to claim 1, wherein said plurality of reinforced ribs comprises:

a plurality of first reinforced ribs each perpendicular to a face of said golf club head; and a plurality of second reinforced ribs each parallel to the face of said golf club head, wherein said plurality of first and second reinforced ribs have a front surface and a rear surface that form a concave portion near an edge of said reinforced ribs such that the edge of said reinforced ribs becomes thinner.

3. A method for manufacturing a golf club, said golf club comprising: a golf club head having a face on a front and formed by an outer shell member so as to be hollow; a shaft having bottom end connected to a neck formed on one side of said golf club head; and a grip provided on an upper portion of said shaft wherein said outer shell member comprises an edge frame made from metal; and a shell body made from resin and provided inwardly relative to said edge frame, said shell body enveloping and entirely covering both front and rear surfaces of an inner edge of said edge frame with the same thickness by a casting manner, wherein said edge frame has an inner edge with (i) a front edge surface of the edge frame adjacent to said inner edge forming a concave portion such that the inner edge becomes thinner, (ii) a rear edge surface of the edge frame adjacent to said inner edge forms a concave portion such that the inner edge becomes thinner, or (iii) both, wherein the method includes steps of:

inserting said edge frame into a pair of molds;

closing the pair of molds and filling molten resin of said shell body into the pair of closed molds; and allowing said molten resin of said shell body to envelop an inner edge of said edge frame by a casting manner so that said edge frame and said shell body are integrated with each other.

4. The method for manufacturing a golf club according to claim 3, wherein said method further includes steps of:

forming a first air gap between a front surface of the inner edge of said inserted edge frame and one of the mold facing the front surface of the inner edge of said inserted edge frame, when the pair of molds are closed;

forming a second air gap between a rear surface of the inner edge of said inserted edge frame and an other of the mold facing the rear surface of the inner edge of said inserted edge frame when the pair of molds are closed; and filling said molten resin into said first and second air gaps.

5. A golf club comprising: golf club head having a face on a front and formed by an outer shell member so as to be hollow; a shaft having a bottom end connected to a neck formed on one side of said golf club head; and a grip provided on an upper portion of said shaft, wherein said outer shell member comprises:

an edge frame made from metal; and a shell body made from resin and provided inwardly relative to said edge frame, said shell body enveloping and entirely covering both front and rear surfaces of an inner edge of said edge frame with the same thickness by casting manner, wherein:

said edge frame comprising a metal has an inner edge, wherein a front surface and a rear surface of the edge frame adjacent to said inner edge form a concave portion such that the inner edge becomes thinner;

said edge frame made from metal has a plurality of first reinforced ribs each perpendicular to a face of said golf club head; and said shell body made from resin envelops said plurality of first reinforced ribs by a casting manner, wherein said plurality of first reinforced ribs have a front surface and a rear surface that form a concave portion near an edge of said first reinforced ribs such that the edge of said first reinforced ribs becomes thinner.

6. The golf club according to claim 5, wherein:

said edge frame made from metal has a plurality of second reinforced ribs each parallel to a face of said golf club head; and said shell body made from resin envelops said plurality of second reinforced ribs by a casting manner, wherein said plurality of second reinforced ribs have a front surface and a rear surface that form a concave portion near an edge of said second reinforced ribs such that the edge of said second reinforced ribs becomes thinner.

7. A golf club comprising; a golf club head having a face on a front and formed by an outer shell member so as to be hollow; a shaft having a bottom end connected to a neck formed on one side of said golf club head; and a grip provided on an upper portion of said shaft, wherein said outer shell member comprises;

an edge frame made from metal; and a shell body made from resin and provided inwardly relative to said edge frame, said shell body enveloping and entirely covering both front arid rear surfaces of an inner edge of said edge frame with the same thickness by casting manner, wherein:

said edge frame made from metal has an inner edge, wherein a front surface and a rear surface of the edge frame adjacent to said inner edge form a concave portion such that the inner edge becomes thinner;

said edge frame made from metal has a plurality of second reinforced ribs each parallel to a face of said golf club head; and said shell body made from resin envelops said plurality of second reinforced ribs by a casting manner, wherein said plurality of second reinforced ribs have a front surface and a rear surface that form a concave portion near an edge of said second reinforced ribs such that the edge of said second reinforced ribs becomes thinner.

8. A golf club comprising: a golf club head having a face on a front and formed by an outer shell member so as to be hollow; a shaft having a bottom end connected to a neck formed on one side of said golf club head; and a grip provided on an upper portion of said shaft, wherein said outer shell member comprises:

an edge frame made from metal; and a shell body made from resin and provided inwardly relative to said edge frame, said shell body enveloping and entirely covering both front anti rear surfaces of an inner edge of said edge frame with the same thickness by casting manner, wherein said edge frame has an inner edge, a front surface of the edge frame adjacent to said inner edge forming a concave portion such that the inner edge becomes thinner.

9. A golf club comprising: a golf club head having a face on a front and formed by outer shell member so as to be hollow; a shaft having a bottom end connected to a neck formed on one side of said golf club head; and a grip provided on an upper portion of said shaft, wherein said outer shell member comprises:

an edge frame made from metal; and a shell body made from resin and provided inwardly relative to said edge frame, said shell body enveloping and entirely covering both front and rear surfaces of an inner edge of said edge frame with the same thickness by casting manner, wherein said edge frame has an inner edge, wherein a rear surface of the edge frame adjacent to said inner edge forms a concave portion such that the inner edge becomes thinner.

* * * * *